United States Patent [19]

Anderson et al.

[11] 4,144,997

[45] Mar. 20, 1979

[54] CONTROL OF MULTIPLE FUEL STREAMS TO A BURNER

[75] Inventors: John E. Anderson; Robert H. Kallenberger, both of Bartlesville, Okla.

[73] Assignee: Phillips Petroleum Company, Bartlesville, Okla.

[21] Appl. No.: 841,510

[22] Filed: Oct. 12, 1977

[51] Int. Cl.[2] ..... F23N 5/02

[52] U.S. Cl. ..... 236/15 BF; 431/90

[58] Field of Search ..... 236/1 E, 15 BG, 15 BF, 236/1 A, 15 BR, 14; 364/477; 431/90

[56] References Cited

U.S. PATENT DOCUMENTS

| | | | |
|---|---|---|---|
| 3,049,168 | 8/1962 | Litwinoff | 236/14 X |
| 3,159,345 | 12/1964 | Osburn, Jr. et al. | 431/90 X |
| 3,722,811 | 3/1973 | Osburn | 236/14 |

*Primary Examiner*—William E. Wayner

[57] ABSTRACT

The control of the flow rates of multiple fuel streams to furnace burners is accomplished by manipulating the flow rate of each fuel stream in response to a calculation of the heat duty which must be supplied by the respective fuel stream. Where the supply of a preferred fuel is variable, the flow rate of the other less preferred fuel stream is varied in response to changes in available supply of the preferred fuel to insure that sufficient fuel is available to the burners to maintain a required process temperature.

37 Claims, 2 Drawing Figures

CONTROL OF MULTIPLE FUEL STREAMS TO A BURNER

Figure 1:
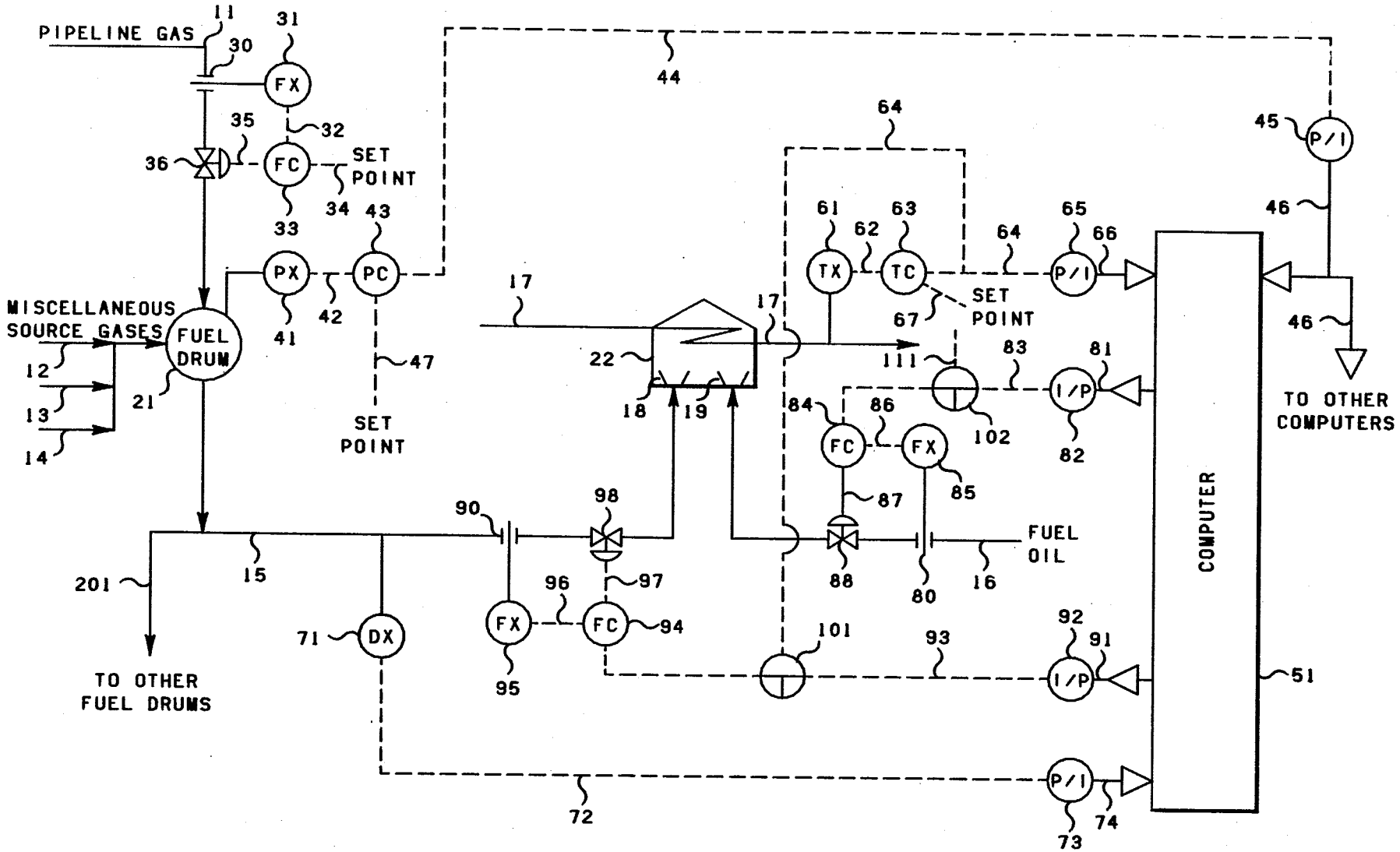

This invention relates to a method and apparatus for controlling the flow rates of multiple fuel streams to furnace burners where each fuel stream has a different heat of combustion. In another aspect this invention relates to a method and apparatus for maintaining a furnace fed by multiple fuel streams at a desired temperature where each fuel stream has a different heat of combustion and the available supply of at least one of the fuels is variable.

It is well known that the available supply of some preferred fuels such as natural gas is not sufficient to supply all industrial demands. This is especially true in the winter months when private usage for heating homes increases. Since this private usage has first priority, industrial users face cut-backs in their natural gas or other preferred fuel supply when shortages occur in a particular geographic area. When this occurs it will be necessary to supplement the preferred fuels with other less preferred fuels such as fuel oil to allow continued operation of certain industrial processes which must be maintained at some required temperature.

The available supply of preferred fuel may vary rapidly because of factors such as weather, shift of supply to other areas, etc. over which the industrial user has no control. It is thus necessary that control systems be developed which can respond rapidly to sudden changes in the available supply of some preferred fuel by supplementing the preferred fuel with some less preferred fuel. It is also necessary that control systems be developed which allow maximum usage of available fuels thus reducing operational cost and conserving fuel.

Accordingly, it is an object of this invention to provide a method and apparatus for controlling the flow rates of multiple fuel streams to furnace burners where each fuel stream has a different heat of combustion. Another object of this invention is to provide a method and apparatus for maintaining a furnace heated by combustion of multiple fuel streams at a desired temperature where each fuel stream has a different heat of combustion and the available supply of at least one of the fuels is variable.

In accordance with the present invention, a method and apparatus is provided for controlling the flow rates of multiple fuels to a furnace and maintaining the furnace process effluent stream at some desired temperature, where the fuels have different heats of combustion and the available supply of at least one of the fuels, usually the preferred fuel, is variable. The total heat duty which is required of the furnace is determined. Also, the percentage of the total heat duty which can be supplied by the preferred fuel is determined. The heat duty which can be supplied by the preferred fuel is then determined by multiplying the total heat duty required of the furnace by the percentage of the total heat duty which can be supplied by the preferred fuel. The required flow rate of the preferred fuel is determined by dividing the heat duty required of the preferred fuel by the heat of combustion of the preferred fuel.

The heat duty which is to be supplied by the other less preferred fuels is determined by subtracting the heat duty which can be supplied by the preferred fuel from the total heat duty of the furnace. The required flow rates of the less preferred fuels is then determined by dividing the required heat duty of each less preferred fuel by the heat of combustion of each less preferred fuel respectively. The fuel streams to the furnace are thus regulated with respect to each other. This promotes efficient use of available fuel and allows rapid, controlled response to variations in the available supply of the preferred fuel and to total heat duty changes due to process and/or environmentally-caused heat demand changes.

Figure 2:
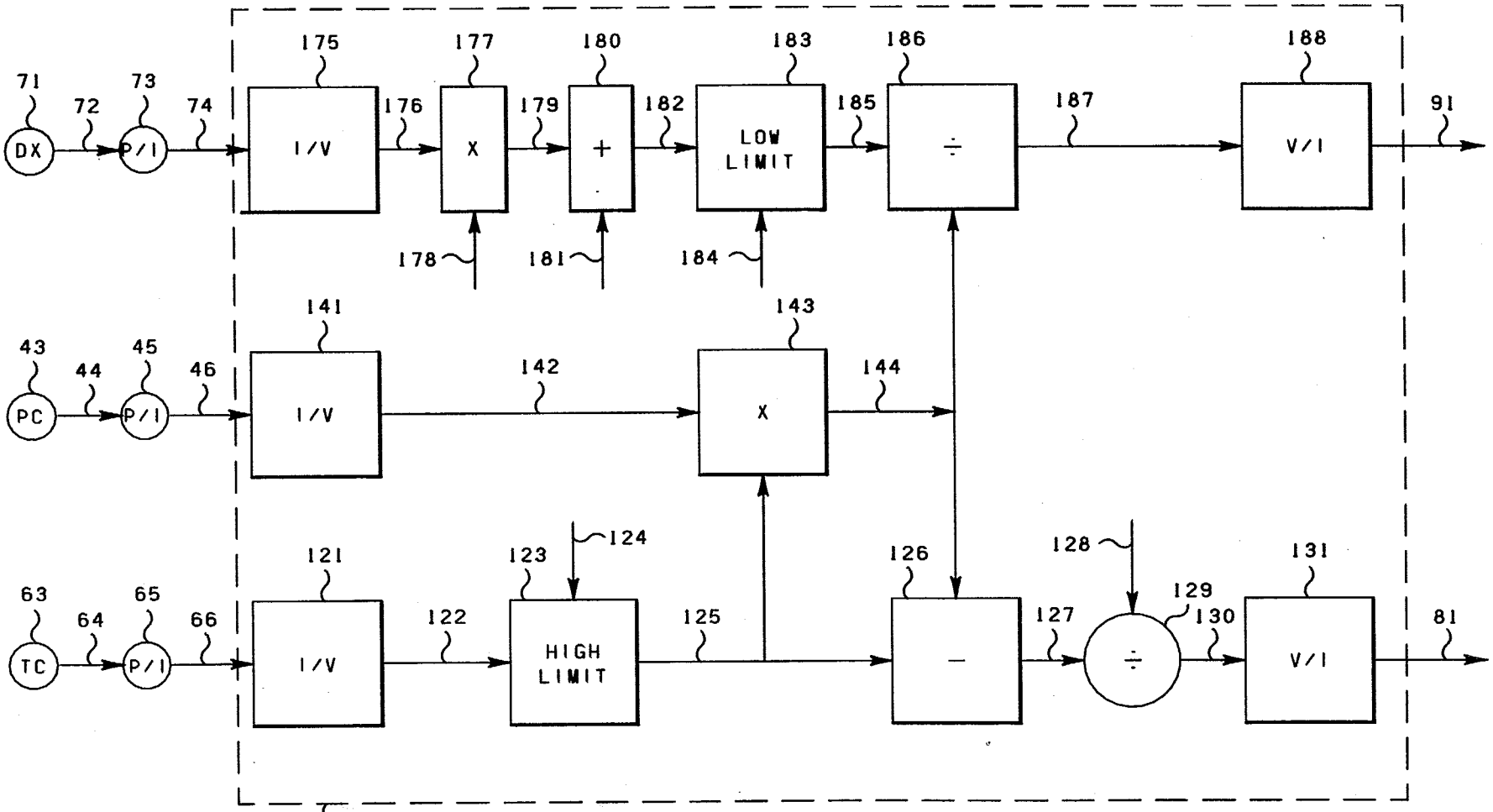

Additional objects and advantages of the invention will be apparent from the following description of a preferred embodiment of the invention as illustrated by the drawings in which:

FIG. 1 is a representation of a control system for a furnace supplied by multiple fuel streams; and FIG. 2 is a representation of the computer logic utilized in controlling a furnace supplied by multiple fuel streams.

For the sake of simplicity the invention is described in terms of a specific furnace which utilizes a mixed natural and low grade plant gas stream, e.g. refinery off-gases, as a preferred fuel, and fuel oil as a less preferred supplemental fuel. Also for the sake of simplicity the invention is described in terms of the control of one furnace supplied by two fuel streams.

Although the invention is illustrated and described in terms of a single furnace which is supplied with natural gas, refinery off-gases, and fuel oil as fuels, the applicability of the use of the invention described herein extends to other processes which must rely on multiple fuel streams to provide the energy necessary to carry out the thermal process. The invention is also applicable to variations, such as the control of a multiplicity of furnaces or the use of fuels other than natural gas, low heating value gases or fuel oil.

Lines designated as signal lines in FIG. 1 can be electrical, pneumatic, mechanical, hydraulic, or other signal means for transmitting information. In almost all control systems, some combination of these types of signals will be utilized, as in FIG. 2. However, use of any other type of signal transmission compatible with the process and the equipment in use, is within the scope of the invention.

Pressure controllers, flow controllers, and temperature controllers shown may utilize the various modes of control such as proportional, proportional plus integral, propotional plus derivative, or proportional plus integral plus derivative as is well known in the art. The preferred controller utilized in this invention is a proportional plus integral controller but any controller capable of accepting two input signals and producing a scaled output signal representative of a comparison of the two input signals is within the scope of the invention.

The scaling of an output signal by a controller is well known in control systems art. Essentially the output of a controller may be scaled to represent any desired factor or variable. An example of this is where a desired pressure and an actual pressure is compared by a controller. The output could be a signal representative of a desired change in the flow rate of some gas necessary to make the desired and actual pressures equal. On the other hand the same output signal could be scaled to represent a percentage which is done in the preferred embodiment of the present invention. If the controller output can range from 0 to 10 volts, which is typical, then the output signal could be scaled so that an output signal having a voltage level of 5.0 volts corresponds to 50%.

Referring now to FIG. 1, pipeline natural gas is fed into fuel drum 21 by means of gas conduit 11. Refinery off gases or gases from other sources are also fed into fuel drum 21 through gas conduits 12, 13 and 14. Any number of gas sources may be feeding fuel drum 21. The mixed gas is fed from fuel drum 21 through gas conduit 15 to furnace 22. Fuel oil is also fed to furnace 22 through fuel oil conduit 16. The gas and fuel oil provide energy to heat the process material flowing through the furnace via conduit 17 by means of separate combustion in burners 18 and 19 respectively.

The supply of the pipeline gas to the system is maintained at a desired level utilizing a flow sensor 30 to measure the flow rate of the pipeline gas flowing through conduit 11. Flow transducer 31 transmits a signal 32 representative of the flow rate of the pipeline gas to flow controller 33. Flow controller 33 is also provided with a set point signal 34. The set point signal 34 is a signal representative of the desired flow rate of pipeline gas. Flow controller 33 compares the set point signal 34 and the signal 32 from flow transducer 31 to establish a difference signal. This difference signal is acted on by the flow controller 33 to establish responsive thereto a control signal 35, which is transmitted to pneumatic control valve 36 located in gas conduit 11. The setting of pneumatic control valve 36 determines the flow rate of the pipeline gas into fuel drum 21.

Pressure sensor/transducer 41 measures the supply pressure of the gas in fuel drum 21 and transmits a signal 42 representative of the measured pressure to pressure controller 43. Pressure controller 43 is also provided with a set point signal 47 representative of the desired gas pressure in fuel drum 21. Pressure controller 43 compares the set point signal 47 and signal 42 from the pressure sensor 41 to establish a difference signal. This difference signal is acted on by pressure controller 43 to produce a control signal 44 responsive thereto, which is transmitted to the pneumatic pressure to electrical current transducer 45 which provides a signal input 46 to a computer means 51. Control signal 44 is representative of a prediction of the percentage of the total heat duty required of the furnace which can be supplied by the total available gas supply. Total heat duty is defined as the total heat input necessary to maintain furnace 22 at a desired operating temperature to transfer the desired heat flow rate into stream 17.

Temperature sensor/transducer 61 measures the temperature of the process material flowing out of furnace 22 through conduit means 17. This information is transmitted as signal 62 to temperature controller 63. Temperature controller 63 is also provided with a set point signal 67 representative of the desired temperature of the process material. Temperature controller 63 compares the set point signal 67 and signal 62 from the temperature sensor 61 to establish a difference signal. The difference signal is acted on by the temperature controller 63 to produce a control signal 64 responsive thereto. The control signal 64 is transmitted to pneumatic pressure to current transducer 65 to produce an electrical current signal 66, which is scaled by temperature controller 63 to be representative of the total heat duty required of the furnace 22. Signal 66 is provided as an input to the computer means 51.

Density (specific gravity) meter 71 measures the specific gravity of the gas flowing in gas conduit 15. A signal 72, representative of the specific gravity, is transmitted to a pneumatic pressure to electrical current transducer 73. Signal 74 from the transducer 73 provides the computer means 51 with the specific gravity of the mixed fuel gas as an input.

The three described input signals to the computer means 51, a prediction of the percentage of total heat duty which can be supplied by gas, total heat duty required of the furnace and specific gravity of the gas, are utilized to compute the flow rates of fuel gas and fuel oil necessary to obtain and maintain the desired furnace temperature when combusted in furnace 22 by burners 18 and 19, respectively.

Output signal 81, provided by the computer means 51 to current to pneumatic pressure transducer 82, is representative of the desired flow rate of fuel oil to its burner 19 in furnace 22. Transducer 82 transmits this information as a pneumatic set point signal 83 to flow controller 84. Flow controller 84 is also provided with information as to the actual flow rate of the fuel oil through conduit 16 as measured by flow sensor 80 and transmitted as signal 86 by flow transducer 85 to flow controller 84. Flow controller 84 compares the set point signal 83 with the actual flow rate signal 86 to establish a difference signal. The difference signal is acted on by flow controller 84 to provide responsive thereto a control signal 87 to pneumatic control valve 88 located in fuel oil conduit 16. The degree of opening of the pneumatic control valve 87 determines the flow rate of the fuel oil to burner 19.

Output signal 91, provided by the computer means 51 to current to pneumatic pressure transducer 92, is representative of the desired flow rate of gas to the furnace 22. Transducer 92 transmits this information as a pneumatic set point signal 93 to flow controller 94. Flow controller 94 is also provided with information as to the actual flow rate of the gas through conduit means 15 as measured by flow sensor 90 and transmitted by flow transducer 95 as signal 96 to flow controller 94. Flow controller 94 compares the set point signal 93 with the actual flow rate signal 96 to establish a difference signal. The difference signal is acted on by flow controller 94 to provide responsive thereto a control signal 97 to pneumatic control valve 98 located in gas conduit 15. The degree of opening of the pneumatic control valve 98 determines the flow rate of the mixed fuel gas to burner 18.

If part of the described system should fail provision is made for continued operation by setting the three way switching valve 102 to allow the flow rate of the fuel oil to be manually controlled by signal 111. Also the three way switching valve 101 may be set in such a manner as to allow temperature controller 63 to manipulate the set point of flow controller 94 and thereby control the flow of gas in conduit 15. In this manner operation may be continued while the automatic control system described in the preceding paragraphs is inoperative. Other non-computer control system configurations may be provided for use at times when the computer-operated system is shut down for calibration, maintenance, etc.

The method for controlling only one furnace is shown in FIG. 1. As many furnaces as desired may be controlled by distributing the gas mixture from fuel drum 21 to other fuel drums via gas conduit 201. Control signal 46, representative of the prediction of the percentage of the total heat duty which can be supplied by the available gas supply, is also supplied to other computers controlling the other furnaces. Each furnace can be controlled by an independent computer exactly as is shown in FIG. 1, utilizing the same measured inputs and providing the same control output signals controlling the flow rate of the fuel oil and the flow rate of the gas mixture for each furnace independently. Only control signal 46 is a common input to all computer systems.

FIG. 2 presents a control logic used by the computer means 51 to calculate the required flow rates of gas and heating oil to maintain the required furnace temperature. Control signal 66, which is representative of the total heat duty ($HD_T$) (e.g. in BTU/Hour) required of the furnace is acted on by the current to voltage transducer 121 which supplies signal 122 to high limiter 123. High limiter 123 is also provided with signal 124 representative of the highest allowable heat duty that can be permitted. If signal 122 is lower than signal 124 then high limiter 123 selects signal 122. If there has been a malfunction and signal 122 is higher than signal 124, then the high limiter selects signal 124. In this way furnace 22 is protected from overheating. Signal 125 is thus representative of the total heat duty required of furnace 22.

Control signal 46 is representative of the predicted percentage of the total heat duty which can be supplied by the available gas supply. Signal 46, which is an electrical current signal, is converted to an electrical voltage signal 142 by current to voltage transducer 141. Signals 125 and 142 are multiplied by multiplying means 143 to produce signal 144 which is representative of the heat duty that is to be supplied by gas ($HD_G$) (e.g. in BTU/Hour). Signal 144 is then subtracted from signal 125 by subtracting means 126 to produce signal 127 which is representative of the heat duty (BTU/Hour) that must be supplied by fuel oil. Signal 128 is a constant value representative of the heat of combustion of fuel oil ($HC_\phi$) (e.g. in BTU/gallon). Signal 127 is divided by signal 128 by dividing means 129 to produce signal 130 which is representative of the required flow rate of fuel oil (in gallons/hour) necessary to provide the heat duty to be supplied by combustion of the fuel oil. Signal 130 is then converted to an electrical current signal by voltage to current transducer 131 to produce signal 81.

Because the heat of combustion of mixed fuel gas varies greatly with its specific gravity which in turn is representative of gas composition, the heat of combustion of the particular gas mixture being fed through gas conduit 15 can be calculated by using the empirical equation $$HC_G = 143.5 + 1415.6(S.G)$$

where $HC_G$ = heat of combustion of the gas (e.g. BTU/-Standard Cubic Foot); and SG = specific gravity of the gas.

This is done by supplying signal 74, the output 72 of measuring device 71 transduced by 73, representative of the gas specific gravity (SG) (commonly called density), to the computer means 51. Signal 74, an electrical current signal, is converted to a voltage signal 176 by the current to voltage transducer 175. Signal 176 which is representative of the gas specific gravity is multiplied by signal 178 representative of the constant 1415.6 by multiplying means 177 to produce signal 179 representative of 1415.6(SG). Signal 179 is then added to signal 181 representative of the constant 143.5 by summing means 180 to produce signal 182 representative of the heat of combustion (BTU/SCF) of the fuel gas. Signal 182 is provided to a low limit device 183 which is also provided with signal 184 representative of the lowest anticipated heating value of the gas mixture. If signal 182 is higher than signal 184 then the low limit device selects signal 182 to be provided to dividing means 186 as signal 185. If there has been a malfunction and signal 184 is higher than signal 182 then the low limiter 183 selects signal 184. This is again a protection device to prevent furnace overheating due to control system malfunction. Signal 185 is thus representative of the heat of combustion of the gas mixture ($HC_G$) (e.g. BTU/SCF). Dividing means 186 divides signal 144, representative of the heat duty required from combustion of the gas mixture (e.g. BTU/Hr), by signal 185, representative of the heat of combustion of the gas mixture (e.g. BTU/SCF), yielding signal 187 representative of the required flow rate (e.g. SCF/Hr) of the gas mixture necessary to provide the heat duty to be supplied by combustion of the gas mixture. Signal 187 is then converted to an electrical current output signal 91 by voltage to current transducer 188.

Restating the essential elements of the functions performed by the analog computer, shown in FIG. 2, in mathematical form; the calculation of the required flow rate of the fuel oil is performed as follows:

(1) $(HD_T)$ (PERCENT) = $HD_G$ (2) $HD_T - HD_G = HD_\phi$ (3) $HD_\phi/HC_\phi = F_\phi$ where $HD_T$ = total heat duty (BTU/Hour)

PERCENT = predicted percentage of total heat which can come from gas combustion.

$HD_G$ = heat duty from combustion of gas mixture (BTU/Hour)

$HC_\phi$ = heat duty from combustion of fuel oil (BTU/-Hour)

$HC_\phi$ = heat of combustion of fuel oil (BTU/Gallon)

$F_\phi$ = required flow rate of fuel oil to provide heat duty required from combustion of fuel oil (Gallons/-Hour).

The calculation of the required flow rate of the gas mixture is performed as follows:

(4) 143.5 + (1415.6 (SG) = $HC_G$ (5) $HD_T$(PERCENT) = $HD_G$ (6) $HD_G/HC_G = F_G$ where SG = specific gravity of gas mixture $HC_G$ = heat of combustion of gas mixture (BTU/-Standard Cubic Foot)

$F_G$ = required flow rate of fuel gas to provide heat duty required from combustion of fuel gas, (SCF/Hour) and $HD_G$, PERCENT, and $HD_T$ are as previously defined.

In a presently preferred method of operation all of the available gas supply is utilized. Fuel oil is used only as necessary to supplement the combustion heat requirements.

It should also be noted that if a fuel other than natural gas is the preferred fuel then a measurement of the specific gravity or other physical property and a subsequent calculation of the heat of combustion may not be necessary if the heat of combustion is known and does not vary substantially.

The invention has been described in terms of its presently preferred embodiment as shown in FIGS. 1 and 2. Specific components which can be used in the practice of the invention as shown in FIGS. 1 and 2 such as controllers 33, 43, 63, 84 and 94; flow transducers 31, 85 and 95; flow sensors 30, 80 and 90; pressure transmitter 61; control valves 36, 88 and 98; current to pressure transducers 82 and 92; and pressure to current transducers 45, 65, and 73 are each well known, commercially available control components such as are described at length in Perry's *Chemical Engineer's Handbook*, 4th Edition, Chapter 22, McGraw-Hill.

Density meter 71 may be a Ranarex density meter manufactured by Permutit. Such a meter is illustrated on page 1297, FIG. 132 of Perry's *Chemical Engineer's Handbook*, 3rd Edition, McGraw-Hill.

Current to voltage transducers 121, 141, and 175; high limiter 123; low limiter 183; multiplying means 177 and 143; summing means 180; subtracting means 126; dividing means 129 and 186; and voltage to current transducers 131 and 188 illustrated in FIG. 2 are all supplied on cards which are part of the Optrol A402 computer system manufactured by Applied Automation Inc., Bartlesville, Oklahoma. All of the components are well known in the art of analog computers.

There is additional conventional equipment such as tanks, furnaces, and conduits illustrated in FIG. 1 which are known to those skilled in the art. Also, there is additional conventional equipment such as pumps, valves and other equipment associated with the schematically illustrated process which have not been specifically illustrated in FIG. 1 but are known by those skilled in the art to be a part of a process such as the one illustrated.

While the invention has been described in terms of the presently preferred embodiment, reasonable variations and modifications are possible, by those skilled in the art, within the scope of the described invention and the appended claims.

That which is claimed is:

1. Apparatus comprising a first burner means;

a second burner means;

first conduit means for supplying a first fuel to said first burner means;

second conduit means for supplying a second fuel to said second burner means;

means for establishing a first signal representative of the total heat duty which must be supplied by said first and second burner means;

means for establishing a second signal representative of the heat duty which can be supplied by said first fuel;

means for establishing a third signal representative of the heat of combustion of said first fuel;

means for dividing said second signal by said third signal to produce a fourth signal representative of the flow rate of said first fuel necessary to provide the heat duty which is to be supplied by said first fuel;

means for manipulating the flow rate of said first fuel to said first burner means in response to said fourth signal;

means for subtracting said second signal from said first signal to produce a fifth signal representative of the heat duty which must be supplied by said second fuel;

means for establishing a sixth signal representative of the heat of combustion of said second fuel;

means for dividing said fifth signal by said sixth signal to produce a seventh signal representative of the flow rate of said second fuel necessary to provide the heat duty required of said second fuel; and means for manipulating the flow rate of said second fuel to said second burner means in response to said seventh signal.

2. Apparatus in accordance with claim 1 wherein said means for establishing said first signal comprises:

means for establishing an eighth signal representative of the actual temperature of the material being heated by said first and second burner means;

means for establishing a ninth signal representative of the desired temperature of said material; and means for comparing said eighth signal and said ninth signal to produce said first signal.

3. Apparatus in accordance with claim 2 wherein said means for establishing said eighth signal is a temperature sensing and transducing means.

4. Apparatus in accordance with claim 2 wherein said means for comparing said eighth signal and said ninth signal to produce said first signal is a temperature controller means.

5. Apparatus in accordance with claim 1 wherein said means for establishing said second signal comprises:

means for establishing an eighth signal representative of the actual pressure of said first fuel;

means for establishing a ninth signal representative of the desired pressure of said first fuel;

means for comparing said eighth signal and said ninth signal to produce a tenth signal which is scaled to represent the percentage of said total heat duty that said first fuel can provide; and means for multiplying said tenth signal by said first signal to produce said second signal.

6. Apparatus in accordance with claim 5 wherein said means for establishing said eighth signal is a pressure sensing and transducing means.

7. Apparatus in accordance with claim 5 wherein said means for comparing said eighth signal and said ninth signal to produce said tenth signal is a pressure controller means.

8. Apparatus in accordance with claim 1 wherein said means for establishing said third signal, where said first fuel is a gaseous mixture which has a variable specific gravity, comprises:

means for establishing an eighth signal representative of the specific gravity (SG) of said first fuel;

means for establishing a ninth signal representative of a first constant;

means for establishing a tenth signal representative of a second constant;

means for multiplying said eighth signal by said ninth signal to produce an eleventh signal; and means for adding said eleventh signal and said tenth signal to produce said third signal.

9. Apparatus in accordance with claim 8 wherein said means for establishing said eighth signal is a density meter capable of measuring the specific gravity of a gaseous mixture.

10. Apparatus in accordance with claim 1 wherein said means for establishing said sixth signal, where said second fuel is a gaseous mixture which has a variable specific gravity, comprises:

means for establishing an eighth signal representative of the specific gravity (SG) of said second fuel;

means for establishing a ninth signal representative of a first constant;

means for establishing a tenth signal representative of a second constant;

means for multiplying said eighth signal by said ninth signal to produce an eleventh signal; and means for adding said eleventh signal and said tenth signal to produce said sixth signal.

11. Apparatus in accordance with claim 10 wherein said means for establishing said eighth signal is a density meter capable of measuring the specific gravity of a gaseous mixture.

12. Apparatus in accordance with claim 1 wherein said means for manipulating the flow rate of said first fuel to said first burner means in response to said fourth signal comprises:

means for establishing an eighth signal representative of the actual flow rate of said first fuel;

means for comparing said fourth signal and said eighth signal and for producing a ninth signal representative of the comparison; and means for manipulating the flow rate of said first fuel in response to said ninth signal.

13. Apparatus in accordance with claim 12 wherein said means for establishing said eighth signal is a flow sensing means and an associated flow transducer means.

14. Apparatus in accordance with claim 12 wherein said means for comparing said fourth signal and said eighth signal and for producing said ninth signal is a flow controller means.

15. Apparatus in accordance with claim 1 wherein said means for manipulating the flow rate of said second fuel to said second burner means in response to said seventh signal comprises:

means for establishing an eighth signal representative of the actual flow rate of said second fuel;

means for comparing said seventh signal and said eighth signal and for producing a ninth signal representative of the comparison; and means for manipulating the flow rate of said second fuel in response to said ninth signal.

16. Apparatus in accordance with claim 15 wherein said means for establishing said eighth signal is a flow sensing means and an associated flow transducer means.

17. Apparatus in accordance with claim 15 wherein said means for comparing said seventh signal and said eighth signal and for producing said ninth signal is a flow controller means.

18. Apparatus comprising:

a first burner means;

a second burner means;

first conduit means for supplying a first fuel to said first burner means;

second conduit means for supplying a second fuel to said second burner means;

means for establishing a first signal representative of the actual temperature of the material being heated by said first and second burner means;

means for establishing a second signal representative of the desired temperature of said material;

means for comparing said first signal and said second signal and for producing a third signal representative of the comparison;

means for establising a fourth signal representative of the actual pressure of said first fuel;

means for establishing a fifth signal representative of the desired pressure of said first fuel;

means for comparing said fourth signal and said fifth signal and for producing a sixth signal representative of the comparison;

means for multiplying said sixth signal by said third signal to produce a seventh signal;

means for establishing an eighth signal representative of the heat of combustion of said first fuel;

means for dividing said seventh signal by said eighth signal to produce a ninth signal representative of the desired flow rate of said first fuel;

means for manipulating the flow rate of said first fuel to said first burner means in response to said ninth signal;

means for subtracting said seventh signal from said third signal to produce a tenth signal;

means for establishing an eleventh signal representative of the heat of combustion of said second fuel;

means for dividing said tenth signal by said eleventh signal to produce a twelfth signal representative of the desired flow rate of said second fuel and means for manipulating the flow rate of said second fuel to said second burner means in response to said twelfth signal.

19. Apparatus in accordance with claim 18 wherein said means for establishing said first signal is a temperature sensing and transducing means and said means for establishing said fourth signal is a pressure sensing and transducing means.

20. Apparatus in accordance with claim 18 wherein said means for establishing said eighth signal where said first fuel is a gaseous mixture which has a variable specific gravity, comprises:

means for establising a thirteenth signal representative of the specific gravity of said first fuel;

means for establishing a fourteenth signal representative of a first constant;

means for establising a fifteenth signal representative of a second constant;

means for multiplying said thirteenth signal by said fourteenth signal to produce a sixteenth signal; and means for adding said sixteenth signal and said fifteenth signal to produce said eighth signal.

21. Apparatus in accordance with claim 20 wherein said means for establishing said eleventh signal where said second fuel is a gaseous mixture which has a variable specific gravity, comprises:

means for establishing a seventeenth signal representative of the specific gravity of said second fuel;

means for establishing an eighteenth signal representative of a first constant;

means for establising a nineteenth signal representative of a second constant;

means for multiplying said seventeenth signal by said eighteenth signal to produce a twentieth signal; and means for adding said twentieth signal and said nineteenth signal to produce said eleventh signal.

22. Apparatus in accordance with claim 21 wherein each of said means for establising said eighth signal and said means for establishing said eleventh signal is a density meter capable of measuring the specific gravity of a gaseous mixture.

23. Apparatus in accordance with claim 18 wherein said means for manipulating the flow rate of said first fuel to said first burner means in response to said ninth signal comprises:

means for establishing a thirteenth signal representative of the actual flow rate of said first fuel;

means for comparing said ninth signal and said thirteenth signal and for producing a fourteenth signal representative of the comparison; and means for manipulating the flow rate of said first fuel in response to said fourteenth signal.

24. Apparatus in accordance with claim 23 wherein said means for manipulating the flow rate of said second fuel to said second burner means in response to said twelfth signal comprises:

means for establishing a fifteenth signal representative of the actual flow rate of said second fuel;

means for comparing said twelfth signal and said fifteenth signal and for producing a sixteenth signal representative of the comparison; and means for manipulating the flow rate of said second fuel in response to said sixteenth signal.

25. Apparatus in accordance with claim 24 wherein each of said means for establishing said thirteenth signal and said means for establishing said fifteenth signal is a flow sensing means and an associated transducer means.

26. A method for regulating the flows of multiple fuel streams to first and second burner means comprising the steps of:

passing a first fuel to said first burner means to therein burn said first fuel to supply heat to a process;

passing a second fuel to said second burner means to therein burn said second fuel to supply heat to said process;

establishing a first signal representative of the total heat duty which must be supplied by said first and second burner means;

establishing a second signal representative of the heat duty which can be supplied by said first fuel;

establishing a third signal representative of the heat of combustion of said first fuel;

dividing said second signal by said third signal to produce a fourth signal representative of the flow rate of said first fuel necessary to provide the heat duty which is to be supplied by said first fuel;

controlling the flow of said first fuel to said first burner means by manipulating the flow rate of said first fuel in response to said fourth signal;

substracting said second signal from said first signal to produce a fifth signal representative of the heat duty which must be supplied by said second fuel;

establishing a sixth signal representative of the heat of combustion of said second fuel;

dividing said fifth signal by said sixth signal to produce a seventh signal representative of the flow rate of said second fuel necessary to provide the heat duty required of said second fuel; and controlling the flow of said second fuel to said second burner means by manipulating the flow rate of said second fuel in response to said seventh signal.

27. A method in accordance with claim 26 wherein said step of establishing said first signal comprises:

establishing an eighth signal representative of the actual temperature of the process being heated by said first and second burner means;

establishing a ninth signal representative of the desired temperature of said process; and comparing said eighth signal and said ninth signal to produce said first signal.

28. A method in accordance with claim 26 wherein said step establishing said second signal comprises:

establishing an eighth signal representative of the actual pressure of said first fuel;

establishing a ninth signal representative of the desired pressure of said first fuel;

comparing said eighth signal and said ninth signal to produce a tenth signal which is scaled to represent the percentage of said total heat duty that said first fuel can provide; and multiplying said tenth signal by said first signal to produce said second signal.

29. A method in accordance with claim 26 wherein said step of establishing said third signal comprises utilizing a constant value for the heat of combustion if the specific gravity or the chemical makeup of said first fuel does not vary greatly with temperature or pressure or does not vary greatly over the period of time that said first fuel is flowing to said first burner means.

30. A method in accordance with claim 26 wherein said step of establishing said eighth comprises utilizing a constant value for the heat of combustion if the density or the chemical makeup of said second fuel does not vary greatly with temperature or pressure or does not vary greatly over the period of time that said second fuel is flowing to said second burner means.

31. A method in accordance with claim 26 wherein said step of establishing said third signal where said first fuel is a gaseous mixture which has a variable specific gravity, comprises:

establishing an eighth signal representative of the specific gravity of said first fuel;

establishing a ninth signal representative of a first constant;

establishing a tenth signal representative of a second constant;

multiplying said eighth signal by said ninth signal to produce an eleventh signal; and adding said eleventh signal and said tenth signal to produce said third signal.

32. A method in accordance with claim 26 wherein said step of establishing said sixth signal, where said second fuel is a gaseous mixture which has a variable specific gravity, comprises:

establishing an eighth signal representative of the specific gravity of said second fuel;

establishing a ninth signal representative of a first constant;

establishing a tenth signal representative of a second constant;

multiplying said eighth signal by said ninth signal to produce an eleventh signal; and adding said eleventh signal and said tenth signal to produce said sixth signal.

33. A method for regulating the flows of multiple fuel streams to first and second burner means comprising the steps of:

passing a first fuel to said first burner means to therein burn said first fuel to supply heat to a process;

passing a second fuel to said second burner means to therein burn said second fuel to supply heat to said process;

establishing a first signal representative of the actual temperature of the process being heated by said first and second burner means;

establishing a second signal representative of the desired temperature of said process;

comparing said first signal and said second signal to produce a third signal representative of the comparison.

establishing a fourth signal representative of the actual pressure of said first fuel;

establishing a fifth signal representative of the desired pressure of said first fuel;

comparing said fourth signal and said fifth signal and producing a sixth signal representative of the comparison;

multiplying said sixth signal by said third signal to produce a seventh signal;

establishing an eighth signal representative of the heat of combustion of said first fuel;

dividing said seventh signal by said eighth signal to produce a ninth signal representative of the desired flow rate of said first fuel;

controlling the flow of said first fuel to said first burner means by manipulating the flow rate of said first fuel in response to said ninth signal;

subtracting said seventh signal from said third signal to produce a tenth signal;

establishing an eleventh signal representative of the heat of combustion of said second fuel;

dividing said tenth signal by said eleventh signal to produce a twelfth signal representative of the desired flow rate of said second fuel; and controlling the flow of said second fuel to said second burner means by manipulating the flow rate of said second fuel in response to said twelfth signal.

34. A method in accordance with claim 33 wherein said step of establishing said eighth signal comprises utilizing a constant value for the heat of combustion if the specific gravity or the chemical makeup of said first fuel does not vary greatly with temperature or pressure or does not vary greatly over the period of time that said first fuel is flowing to said first burner means.

35. A method in accordance with claim 33 wherein said step of establishing said eleventh signal comprises utilizing a constant value for the heat of combustion if the density or the chemical makeup of said second fuel does not vary greatly with temperature or pressure or does not vary greatly over the period of time that said second fuel is flowing to said second burner means.

36. A method in accordance with claim 33 wherein said step of establishing said eighth signal, where said first fuel is a gaseous mixture which has a variable specific gravity, comprises:

establishing a thirteenth signal representative of the specific gravity of said first fuel;

establishing a fourteenth signal representative of a first constant;

establishing a fifteenth signal representative of a second constant;

multiplying said thirteenth signal by said fourteenth signal to produce a sixteenth signal; and adding said sixteenth signal and said fifteenth signal to produce said eighth signal.

37. A method in accordance with claim 33 wherein said step of establishing said eleventh signal, where said second fuel is a gaseous mixture which has a variable specific gravity, comprises:

establishing a thirteenth signal representative of the specific gravity of said second fuel;

establishing a fourteenth signal representative of a first constant;

establising a fifteenth signal representative of a second constant;

multiplying said thirteenth signal by said fourteenth signal to produce a sixteenth signal; and adding said sixteenth signal and said fifteenth signal to produce said eleventh signal.

* * * * *